United States Patent [19]

Demmy

[11] 4,002,941

[45] Jan. 11, 1977

[54] SHADOW MASK CATHODE RAY TUBE SHIELD

[75] Inventor: Robert C. Demmy, Lancaster, Pa.

[73] Assignee: RCA Corporation, New York, N.Y.

[22] Filed: July 1, 1968

[21] Appl. No.: 763,996

Related U.S. Application Data

[63] Continuation of Ser. No. 590,093, Oct. 27, 1966, which is a continuation of Ser. No. 374,754, June 12, 1964, abandoned.

[52] U.S. Cl. ..... 313/402; 313/408

[51] Int. Cl.[2] ..... H01J 29/07; H01J 31/20

[58] Field of Search ..... 313/85, 64, 70 C, 5, 313/89, 92, 92 B, 240, 92 PD

[56] References Cited

UNITED STATES PATENTS

| | | | |
|---|---|---|---|
| 2,762,942 | 9/1956 | Palmer | 313/85 S |
| 2,806,165 | 9/1957 | Law | 313/85 S |
| 2,906,904 | 9/1959 | Woughter et al. | 313/402 |
| 2,951,179 | 8/1960 | Evans | 313/92 PD X |
| 3,005,921 | 10/1961 | Godfrey | 313/85 S |
| 3,183,388 | 5/1965 | Townsend et al. | 313/82 |
| 3,304,455 | 2/1967 | Mesta | 313/94 |
| 3,358,170 | 12/1967 | Fiore | 313/85 S X |
| 3,377,493 | 4/1968 | Levin et al. | 313/85 S X |
| 3,404,303 | 10/1968 | Levin | 313/85 S |

*Primary Examiner*—Robert Segal
*Attorney, Agent, or Firm*—Glenn H. Bruestle; Dennis H. Irlbeck

[57] ABSTRACT

A rectangular multi-apertured shadow mask electrode having a rectangular peripheral reinforcing frame of L shaped cross section is mounted within the rectangular envelope of a color cathode ray tube adjacent to the faceplate with a spacing gap between the frame and the side wall of the envelope. An electron shield of thin metal (e.g. Al) foil extends around and across the spacing gap to prevent scattering of beam electrons during overscan of the mask. The shield comprises an inner flange attached to one flange of the frame by means of tabs and an outer flange pessed against the side wall of the envelope. At each corner, the shield includes a portion of U-shaped cross-section disposed within the spacing gap with the sides of the U resiliently engaging the envelope side wall and the other flange of the frame.

20 Claims, 20 Drawing Figures

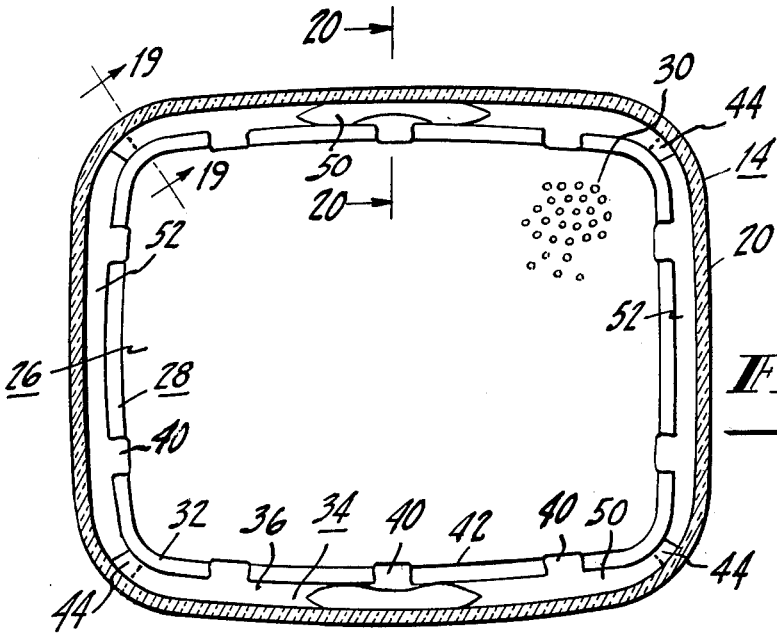
Fig. 2.
Fig. 1.
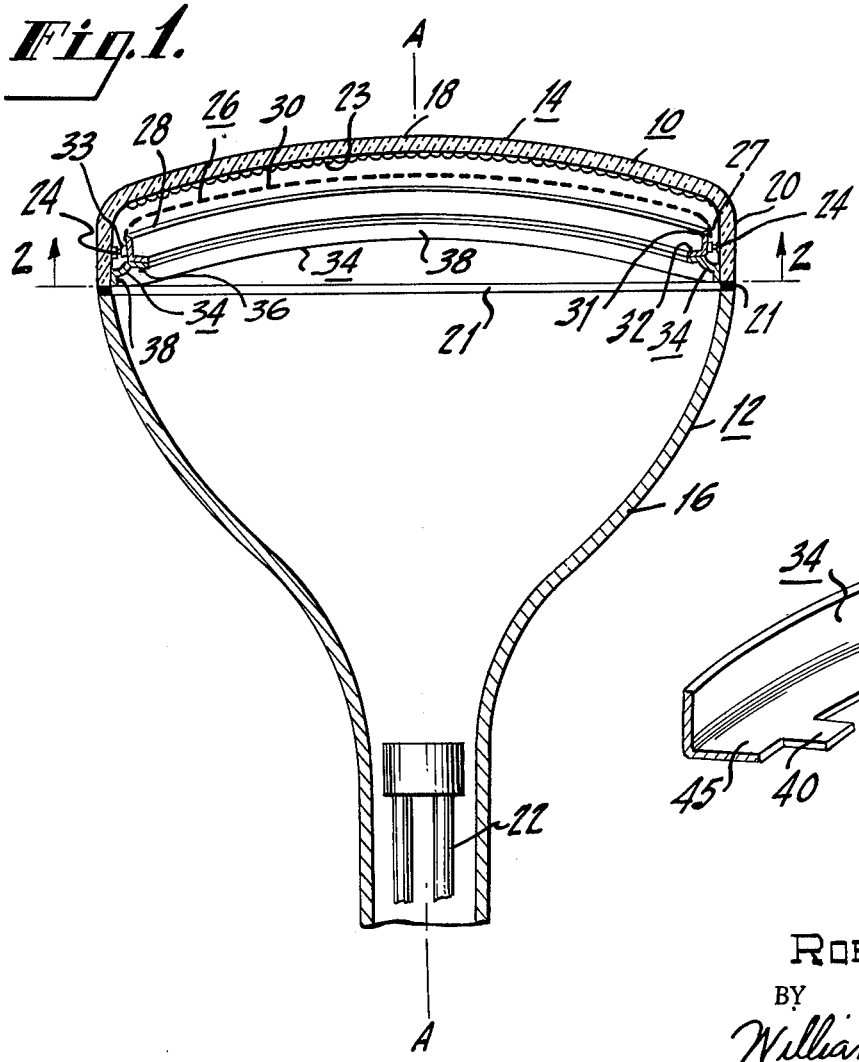
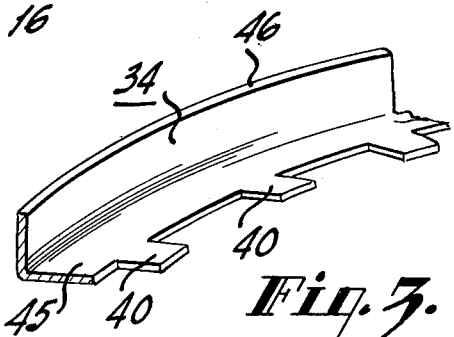
Fig. 3.
INVENTOR.
ROBERT C. DEMMY
BY
William A. Galesak
BY
Attorney Fig. 4.
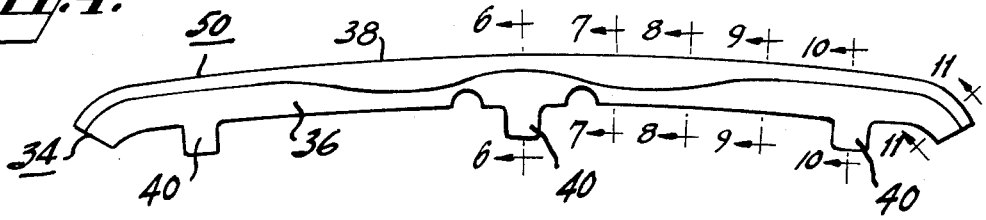
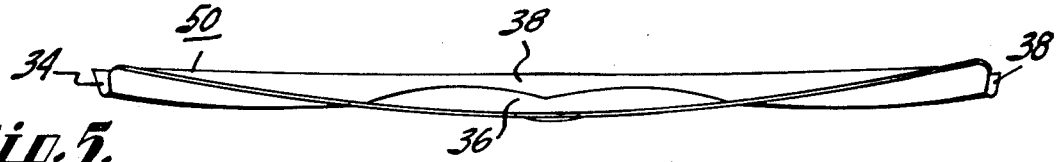
Fig. 5.
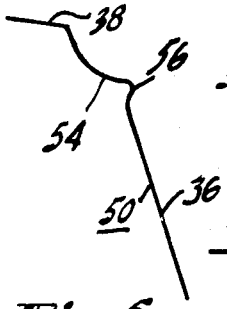
Fig. 6.
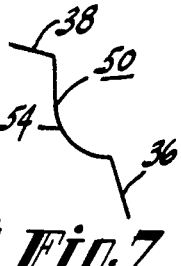
Fig. 7
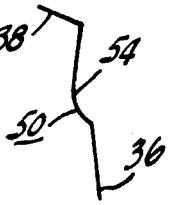
Fig. 8.
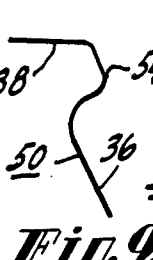
Fig. 9.
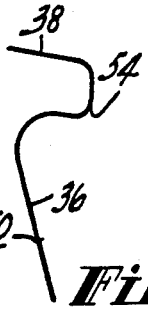
Fig. 10.
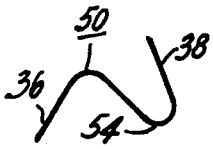
Fig. 11.
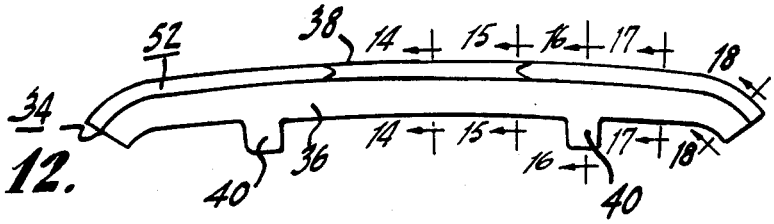
Fig. 12.
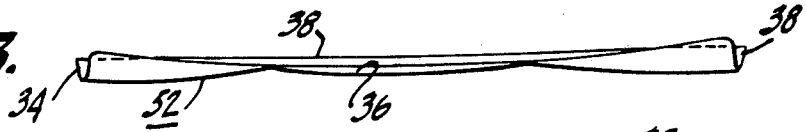
Fig. 13.
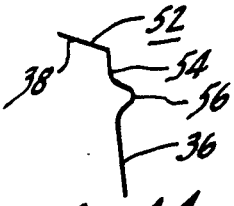
Fig. 14.
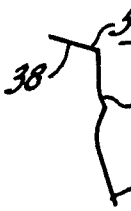
Fig. 15.
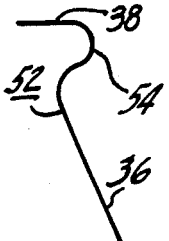
Fig. 16.
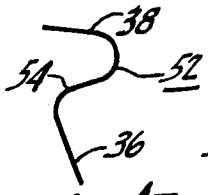
Fig. 17.
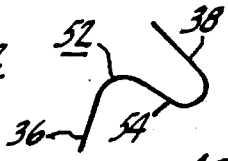
Fig. 18.
INVENTOR.
ROBERT C. DEMMY
BY
William A. Galesak
Attorney INVENTOR.
ROBERT C. DEMMY
BY
William A. Zalesak
Attorney

SHADOW MASK CATHODE RAY TUBE SHIELD

This application is a continuation of my copending application Ser. No. 590,093, filed Oct. 27, 1966, which is a continuation of my copending application Ser. No. 374,754 filed June 12, 1964, now abandoned.

This invention relates to cathode ray tubes of the shadow mask type and particularly to electron shield means therefor.

Shadow mask color cathode ray tubes usually include an envelope panel member comprising a faceplate and a peripheral side wall. A mosaic screen of phosphor dots is disposed on the inner surface of the faceplate. A multiapertured shadow mask electrode is mounted within the panel member adjacent to the phosphor screen and is surrounded by the side wall. The diameter of the apertured electrode is slightly smaller than that of the panel side wall so that a gap of about ½-inch exists between the periphery of the electrode and the side wall.

In normal operation of the tube, the electron beam is scanned in a rectangular raster over the shadow mask electrode and phosphor screen. In order to completely cover all portions of the screen, the electrode is overscanned in some places. This results in electrons being projected into the gap between electrode and the side wall, and eventually onto the phosphor screen. This produces an undesirable luminescent glow around the periphery of the screen.

In accordance with prior art practices, a stiff sheet metal strip electron shield is welded to the mask electrode and extends to adjacent to the panel side wall to intercept the over-scanning electrons. If the stiff sheet metal electron shield is positioned so that it abuts the side wall, then when the tube is finish-processed by a final high temperature bake-out, the mask and shield expand (more than the glass panel) causing the shield to exert a force on the mask which distorts the mask and affects its alignment and spacing relative to the screen. If the stiff sheet metal electron shield is spaced from the side wall so as to prevent mask distortion during bake-out, then some electrons are projected through the space between the electron shield and the side wall and cause peripheral screen glow. Although such glow is indeed much less than when no shield at all is provided, it nevertheless is frequently sufficient to be objectionable.

It is an object of this invention to provide a shadow mask cathode ray tube having improved electron shield means.

This invention may be embodied in a shadow mask cathode ray tube having a shadow mask electrode comprising a generally rectangular frame across which is mounted a multi-apertured sheet metal masking member. According to the invention, an electron shield comprising a double-flanged strip of metal foil is fixed to the mask and completely blocks the gap between the mask and the panel side wall. The foil strip has a first flange extending along the strip at one edge thereof. This first flange is disposed transversely to the longitudinal axis of the cathode ray tube and against the mask frame. The strip may be secured to the mask frame by a plurality of tabs integral with the first flange which are crimped around the inner rim of the frame. A second flange extending along the strip at the other edge thereof is pressed outwardly against the panel side wall so that the foil strip is conformed closely to the side wall, thus blocking the gap between the mask and the side wall. The pressing can be performed, for example, by a person passing his finger around the side wall against the foil strip or by the use of a suitable tool operated in a similar manner.

In the drawings:

FIG. 1 is a longitudinal section of a shadow mask cathode ray tube embodying the invention;

FIG. 2 is a transverse section taken along line 2—2 of FIG. 1;

FIG. 3 is a perspective of one form of electron shield suitable for use in the tube of FIGS. 1 and 2;

Figure 19:
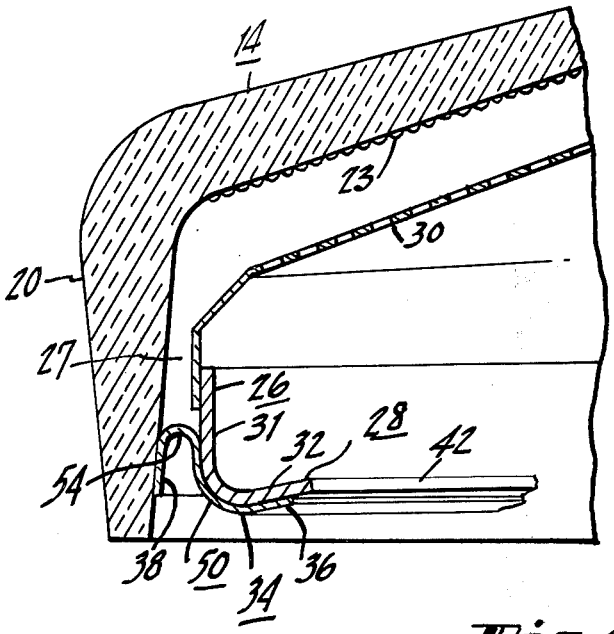
Figure 20:
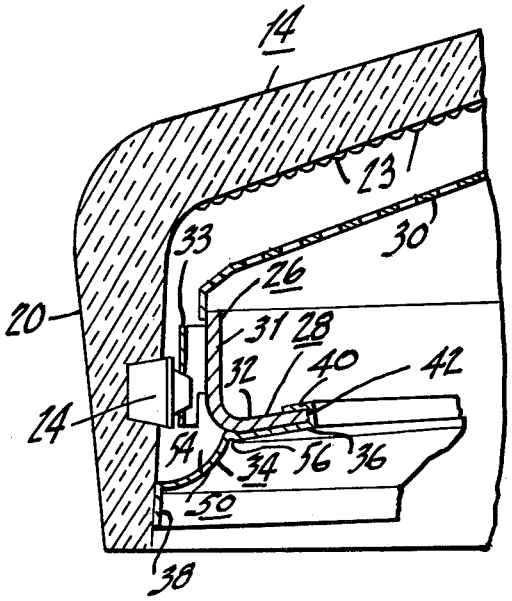

FIGS. 4–18 are various enlarged elevation, plan, and section views of another form of electron shield useable in the tube of FIGS. 1 and 2; and FIGS. 19 and 20 are enlarged sections of a portion of the tube of FIGS. 1 and 2 taken respectively along lines 19—19 and 20—20 of FIG. 2.

Referring to the drawings, a cathode ray tube 10 having a central longitudinal axis A—A includes an envelope 12 comprising a faceplate panel 14 and a funnel 16. The panel 14 includes a faceplate portion 18 disposed centrally and perpendicularly to the axis A—A and a peripheral side wall 20 which extends generally parallel to the axis A—A. The panel 14 is sealed at its open end to the large opening of the funnel 16 by a frit seal 21.

A plural electron gun assembly 22 is disposed within the neck of the funnel 16. The gun assembly is adapted to project a plurality of electron beams toward the faceplate 18.

A mosaic screen 23 of phosphor dots is disposed on the inner surface of the faceplate 18. A plurality of electrode mounting studs 24 are secured to, and extend inwardly from, the inner surface of the side wall 20. A multi-apertured shadow mask electrode 26 is mounted within the panel 14 on the studs 24. The electrode 26 is disposed adjacent to the mosaic screen 23 and is surrounded by the side wall 20 with a spacing gap 27 between the electrode and the side wall. The electrode 26 comprises a generally rectangular frame 28 across which is mounted a multi-apertured sheet metal masking member 30. The frame 28 is of L-shaped cross-section having an "axial" peripheral flange 31 which is substantially parallel to the axis A—A and a "transverse" flange 32 which extends inwardly toward the axis A—A. The masking member 30 is secured to the axial flange 31 near the edge of this flange. A plurality of leaf support springs 33 are attached to the outer surface of the axial flange 31 and are provided with apertures into which the studs 24 are received to support the shadow mask electrode 26 within the panel 14.

A foil strip electron shield 34 is disposed in contact with both the mask frame 28 and the panel side wall 20 so that it blocks or closes the gap 27 between the mask electrode 26 and the side wall 20. The shield 34 includes a transverse (to the axis A—A) flange 36 along one side of the strip and an axial flange 38 along the other side of the strip. A plurality of tabs, 40, which extend from the transverse flange 36, are provided for securing the shield 34 to the mask frame 28.

The foil shield 34 is disposed so that its transverse flange 36 lies flush against the transverse flange 32 of the mask frame 28. The tabs 40 are crimped over the inner rim 42 of the frame flange 32 to secure the foil shield 34 in place. The axial flange 38 of the foil shield 34 is then pressed against the inner surface of the panel side wall 20 so that it lies flush against the side wall 20. This pressing may be accomplished, for example, by a person passing his finger around the panel 14 so as to press the foil shield 34 toward the gap 27 and against the panel side wall 20. Alternatively, a suitable tool may be used to conform the strip shield 34 to the panel side wall 20.

The foil shield 34 may for convenience be provided as four separate pieces, each lying along one side of the rectangular mask electrode 26. The separate lengths of the foil shield 34 may be sightly overlapped and interlocked at the corners of the electrode 26 as indicated at 44.

FIG. 3 illustrates one simple form in which a length of the foil shield 34 may be provided prior to its being installed in the tube 10. In this form, the shield 34 has a substantially right-angle, L-shaped cross-section consisting essentially of a transverse flange 45 and an axial flange 46, both of which are substantially flat. Tabs 40 are provided on the transverse flange 45. After being positioned and pressed into place, the FIG. 3 form of the shield 34 may be considerably distorted from the right-angle shape illustrated, so as to conform to the mask frame and panel sidewall. Furthermore, the shield may be pressed into the gap 27 between the mask electrode 26 and panel sidewall 20 (for a purpose hereinafter described) so that its two flanges 45 and 46 are somewhat separated from each other by a U-shaped section of the shield extending into the gap.

FIGS. 4–18 illustrate a preferred form in which the foil shield 34 is provided prior to its being installed in the tube 10. The shield form of these figures is provided as four separate parts, two of a long part 50 illustrated by FIGS. 4–11, and two of a short part 52 illustrated by FIGS. 12–18. FIGS. 4 and 5 are respectively plan and elevation views of the long part 50. FIGS. 6–11 are various enlarged sections thereof. Similarly, FIGS. 12 and 13 are plan and elevation views and FIGS. 14–18 various enlarged sections of the short part 52. As shown in FIG. 2, two of the long parts 50 are designed to fit neatly along the two long sides of the mask electrode 26 and panel 14 and two of the short parts 52 along the two short sides. Both the long part 50 and the short part 52 comprise the transverse flange 36, the axial flange 38, and an intermediate section 54. The intermediate section 54 varies considerably in shape along the length of both the shield parts 50 and 52. FIGS. 19 and 20 illustrate the purposes of such variation.

As shown in FIG. 19, the intermediate section 54 of foil shield 34 is shaped to dip into the gap 27 in the four corner regions of the panel 14 where electron overscanning is most severe. Each section 54 is disposed within the spacing gap 27 with the sides of the U resiliently engaging the sidewall 20 and the axial flange 31 of the frame 28. The shape of the intermediate sections 54 at these regions results in a cantilever spring-like action which urges the axial flange 38 of the shield against the panel sidewall 20 to insure a good closing of the gap 27. In the central regions of the four sides of the panel 14, the presence of the studs 24 and support springs 33 prevents a similar dipping of the shield 34 into the gap 27. At the side regions the intermediate section 54 has a reverse dip in order to clear the studs and springs, as shown in FIGS. 1, 6, 14 and 20. However, in these side regions (where electron overscanning is less severe) the gap 27 is adequately closed simply by pressing the axial flange 38 of the shield against the panel side wall 20. If desired the foil shield 34 may be provided with an accordion-like fold 56 (FIGS. 6, 14, 20) between the transverse flange 36 and the axial flange 38 to produce a spring action in the side regions to urge the axial flange 38 against the side wall 20. Whether or not the foil shield dips into the gap 27, it is nevertheless shaped so that the axial shield flange 38 lies generally parallel to and against the side wall 20, as shown in FIGS. 1, 19 and 20. Thus, even if the shield does not make a continuous line of contact completely around the side wall 20, the passageway between the axial shield flange 38 and the side wall 20 will be so narrow and long and sufficiently nonaligned with the electron paths that any electrons are prevented from passing through the gap 27 and striking the screen 23.

The foil for the shield 34 may be of any suitable metal, such as aluminum or steel. A preferred material is 0.003–0.004 inch thick aluminum foil having a black ceramic coating on one side thereof. Such blackened aluminum is marketed commercially by Revere Copper & Brass, Inc. The shield may be installed with its black coated surface out of contact with and facing away from both the mask frame 28 and the panel sidewall 20. This provides desirably good heat radiation properties which contribute to maintaining as low a temperature of the mask electrode 26 as possible. The pliability and resilience of 0.003–0.004 inch thick aluminum has been found to be highly satisfactory.

The thickness of the foil should be such that it can be easily permanently deformed by hand to exceed its elastic limit. The resilience of the foil should be sufficiently low so that it can be pressed against the panel side wall and conformed thereto without a significant inward spring-back away from the side wall when the pressing force is removed. Absence of spring-back can best be assured by pressing the foil shield, where possible, slightly into the gap 27 between the mask electrode 26 and the side wall 20, as well as against the side wall. At the same time, the foil, once pressed against the side wall 20, should have sufficient resilience so that when the mask is heated and expands (e.g., 20 thousandths of an inch toward the side wall), the foil will yield to the expansion without exceeding its elastic limit. Thus, when the mask cools and contracts, the foil shield will exhibit an outward spring-back and remain in contact with the side wall 20.

By virtue of the double flange shape of the foil shield 34, a substantial surface portion of the axial flange thereof can be disposed flush with the side wall 20. This assures complete closing of the gap 27 and complete interception of the over-scanning electrons.

By virtue of the shield tabs 40, the foil shield 34 can be secured to the mask frame 38 without the necessity of separate securing means such as a weld or a clamp. Such a self-securing property of the shield 34 also facilitates fabrication of the cathode ray tube 10 because the shield 34 need not be temporarily secured in place (such as by a fabricator's hand) while some separate permanent securing means or force is being applied.

In one embodiment of the invention, the foil shield 34 has been constituted of aluminum foil having a thickness of 0.003 inch. In another embodiment of the invention, the foil shield 34 has been constituted of cold rolled steel foil having a thickness of 0.002 inch.

Aluminum foil may be preferred because of the ease with which it can be formed and the freedom from the likelihood of personnel injury (e.g. cutting a finger on a sharp edge) during the forming thereof which it offers. Also, compared to steel, aluminum foil will more readily yield without distorting the mask when high temperature expansion occurs because of the reduction in its strength at high temperatures.

Steel foil may be preferred because of the ease with which it can be provided with a heat-radiating blackened surface coating which is suitable for incorporation internally of the cathode ray tube 10.

I claim:

1. A cathode ray tube including an envelope panel comprising a faceplate and a peripheral side wall, a mask electrode including a multi-apertured masking portion and a peripheral reinforcing and supporting portion, said mask electrode being disposed within said panel and surrounded by said side wall with a continuous spacing gap between said side wall and said peripheral portion, means for projecting electrons toward said electrode, and an electron shield extending between said electrode and said side wall and completely blocking the passage of electrons through said spacing gap; said shield comprising a strip of metal foil and extending entirely around said gap and having a pair of flanges extending along the length thereof, one of said flanges extending along and secured to said electrode, the other flange extending along and conforming closely to said side wall, said peripheral portion of said mask electrode comprising a plurality of mounting members located within said spacing gap and supporting said electrode in said panel, said mounting members being completely shielded from said electrons by said electron shield.

2. The cathode ray tube of claim 1, wherein said faceplate, side wall and mask electrode have similar generally rectangular shapes with rounded corners, and said electron shield is made up of four pieces each lying along one side of the rectangle, with the ends of adjacent pieces overlapped at the corners of the rectangle.

3. The cathode ray tube of claim 1, wherein said peripheral portion of said electrode comprises a frame of L-shaped cross-section across which said masking member is mounted, and said one shield flange is disposed against and secured to one of the flanges of said frame by tabs extending from said one shield flange and crimped over the rim of said one frame flange.

4. A cathode ray tube including an envelope panel comprising a faceplate and a peripheral side wall, a multi-apertured mask electrode mounted within said panel and surrounded by said side wall with a spacing gap between said side wall and said mask electrode, said faceplate, side wall and mask electrode having similar generally rectangular shapes with rounded corners whereby an electron beam scanning a rectangular raster on said mask electrode tends to overscan said mask electrode particularly at said corners, and an electron shield of metal foil extending between said mask electrode and said side wall and completely blocking the passage of electrons through said gap, said shield comprising a pair of flanges extending along the length thereof, one flange being secured to said mask electrode and the other flange being pressed against said side wall to conform thereto, said shield comprising a substantial portion of U-shaped cross-section at each of said corners disposed within said spacing gap with the sides of the U resiliently engaging said side wall and the outer edge of said mask electrode.

5. The cathode ray tube of claim 4, wherein said mask electrode includes a peripheral frame to which said one flange is secured.

6. A cathode ray tube including an envelope panel comprising a faceplate and a peripheral side wall, a multi-apertured mask mounted within said panel and having a peripheral frame of L-shaped cross-section surrounded by said side wall with a spacing gap between said side wall and said frame, said faceplate, side wall, mask and frame having similar generally rectangular shapes with rounded corners whereby an electron beam scanning a rectangular raster on said mask tends to overscan said mask particularly at said corners, and an electron shield of metal foil disposed between said frame and said side wall and spanning said gap, said shield comprising a pair of flanges extending along the length thereof, one shield flange being secured to one of the L flanges of said frame and the other shield flange being pressed against said side wall to conform thereto, said shield comprising a substantial portion of U-shaped cross-section at each of said corners disposed within said spacing gap with the sides of the U resiliently engaging said side wall and the other flange of said frame.

7. A cathode ray tube including an envelope panel comprising a faceplate and a peripheral side wall, an electrode disposed in said panel and comprising a frame of L-shaped cross-section and a multi-apertured sheet metal masking member mounted thereacross, and an electron shield comprising a metal foil strip having a pair of flanges extending along the length thereof, one of the flanges of the strip having tabs extending therefrom, said foil strip being disposed with the tabbed flange thereof against one of the L flanges of the frame with said tabs being crimped over the rim of said one frame flange and with the other flange of the strip being pressed against said side wall.

8. The cathode ray tube of claim 7 wherein: said frame is surrounded by said side wall with a spacing gap between said side wall and said frame; said faceplate, side wall, masking member and frame have similar generally rectangular shapes with rounded corners whereby an electron beam scanning a rectangular raster on said masking member tends to overscan said masking member particularly at said corners; said electron shield spans said gap and comprises a substantial portion of U-shaped cross-section at each of said corners extending a substantial distance into said gap and resiliently wedged between said side wall and said frame.

9. A cathode ray tube having a central longitudinal axis and comprising:

a. an envelope including a panel member and a funnel member, said panel member comprising a faceplate disposed centrally perpendicularly to said axis and a side wall extending substantially axially from the periphery of said faceplate, b. a mosaic screen of phosphor dots on said faceplate, c. electron gun means disposed within the neck of said funnel and adapted to project electrons toward said screen, d. a shadow mask electrode mounted within said panel surrounded by said side wall, said electrode comprising a frame and a multi-apertured sheet metal masking member mounted thereacross, said frame having an L-shaped cross-section with a transverse flange of the frame L disposed substantially perpendicularly to said axis and an axial flange of the frame L disposed substantially parallel to said axis and spaced by a gap from said side wall, and e. an electron shield comprising a strip of aluminum foil having a black ceramic coating thereon and having first and second flanges extending along the length of the strip at the two longitudinal edges thereof, said first flange including integral tabs extending laterally therefrom, said shield being disposed with said first flange against said transverse frame flange and with said tabs extending inwardly toward said axis and crimped around the rim of said transverse frame flange, said second flange of said shield being disposed with a substantial portion lying flush against said sidewall, said foil shield further including along selected portions thereof a longitudinally extending U-shaped intermediate section between said flanges and extending into said gap to urge said second flange against said sidewall in a cantilever-like action.

10. The cathode ray tube of claim 9 wherein said electron shield can be easily permanently deformed by hand by a person, and which after being pressed against said side wall will not have its elastic limit exceeded when deformed by 20 thousandths of an inch due to thermal expansion of said electrode.

11. A cathode ray tube having a central longitudinal axis and comprising:

a. an envelope including a faceplate disposed centrally perpendicularly to said axis and a side wall extending substantially axially from the periphery of said faceplate, b. a mosaic screen of phosphor dots on said faceplate, c. electron gun means disposed within said envelope and adapted to project electrons toward said screen, d. a shadow mask electrode mounted within said envelope and surrounded by said side wall, said electrode comprising a frame and a multi-apertured sheet metal masking member mounted thereacross, said frame having an L-shaped cross-section with a transverse flange of the frame L disposed substantially perpendicularly to said axis and an axial flange of the frame L disposed substantially parallel to said axis and spaced by a gap from said side wall, and e. an electron shield comprising a strip of metal foil having first and second flanges extending along the length of the strip at the two longitudinal edges thereof, said first flange including integral tabs extending laterally therefrom, said shield being disposed with said first flange against said transverse frame flange and with said tabs extending inwardly toward said axis and crimped around the rim of said transverse frame flange, said second flange of said shield being disposed with a substantial portion lying flush against said sidewall.

12. A color television picture tube comprising an evacuated envelope having a panel including a curved viewing surface terminating in a peripheral wall and a funnel; a screen consisting of a plurality of different colored-light emitting phosphors deposited on the inside of said viewing surface; an aperture mask spaced a predetermined distance from said screen; a rigid frame supporting said mask; a plurality of mounting studs arranged about the interior of said peripheral wall; spring means for removably mounting said frame to said mounting studs; said frame necessarily being substantially smaller than said panel, and when in position, creating a peripheral gap between the edge of said frame and said wall; said gap being undesirable in that fortuitous electrons which overscan said frame may reach said screen and cause undesirable illumination of edge portions thereof; and a steel foil shield physically closing said gap between the wall and the frame, said steel foil shield being blackened to improve its heat radiation characteristics and being in thermal contact with said frame.

13. A color television picture tube as set forth in claim 12, wherein said peripheral wall of the panel terminates in a seal edge for subsequent glass to glass sealing engagement with said funnel; said frame having a substantially L-shaped cross-section with a first leg parallel to and a second leg perpendicular to said peripheral wall; said frame, mask and shield when in assembled position being wholly within said panel for safer and more convenient handling during processing; said steel foil shield including a peripheral edge contoured toward said screen for snugly engaging said peripheral wall when in position, said shield also intimately contacting substantially the entire surface of said second leg to maximize heat transfer from said frame to said shield.

14. A color television picture tube comprising an evacuated envelope having a panel including a curved viewing surface terminating in a peripheral wall and a funnel; a screen consisting of a plurality of different colored light emitting phosphors deposited on the inside of said viewing surface; an aperture mask spaced a predetermined distance from said screen; a frame supporting said mask; a plurality of mounting studs arranged about the interior of said peripheral wall; spring means for mounting said frame to said mounting studs; said frame necessarily being substantially smaller than said panel, and when in position, creating a peripheral gap between the edge of said frame and said wall; said gap being undesirable in that fortuitous electrons which overscan said frame may reach said screen and cause undesirable illumination of edge portions thereof; and a metal foil shield physically closing said gap between the wall and the frame, said shield being blackened to improve its heat radiation characteristics and being in thermal contact with said frame.

15. A color television picture tube as set forth in claim 14, wherein said peripheral wall of the panel terminates in a seal edge for subsequent glass to glass sealing engagement with said funnel; said frame having a substantially L-shaped cross-section with a first leg parallel to and a second leg perpendicular to said peripheral wall; said frame, mask and shield when in assembled position being wholly within said panel for safer and more convenient handling during processing; said shield including a peripheral edge having a contour similar to the inner surface of said peripheral wall for snugly engaging said wall when in position, said shield also intimately contacting substantially the entire surface of said second leg to maximize heat transfer from said frame to said shield.

16. A color television picture tube as set forth in claim 12, wherein said peripheral wall of the panel terminates in a seal edge for subsequent glass to glass sealing engagement with said funnel; said frame having a substantially L-shaped cross-section with a first leg parallel to and a second leg perpendicular to said peripheral wall; said frame, mask and shield when in assembled position being wholly within said panel for safer and more convenient handling during processing; said steel foil shield being sufficiently rigid to resist deformation by handling, and including a peripheral edge contoured toward said screen for snugly engagng said peripheral wall when in position, said shield also intimately contacting substantially the entire surface of said second leg to maximize heat transfer from said frame to said shield.

17. A color television picture tube as set forth in claim 12, wherein said peripheral wall of the panel terminates in a seal edge for subsequent glass to glass sealing engagement with said funnel; said frame having a substantially L-shaped cross-section with a first leg parallel to and a second leg perpendicular to said peripheral wall; said frame, mask and shield when in assembled position being wholly within said panel for safer and more convenient handling during processing; said steel foil shield including a peripheral edge contoured toward said screen for snugly engaging said peripheral wall when in position, said shield also intimately contacting substantially the entire surface of said second leg to maximize heat transfer from said frame to said shield.

18. In a color cathode-ray tube of the type having a glass envelope comprising a generally rectangular image screen panel section and a mating funnel section adapted to be sealed thereto, an interlaced pattern of different kinds of phosphor materials disposed on said screen, an electron gun means for developing at least one electron beam to be scanned across said screen, and a generally rectangular structural frame attached to said envelope but spaced therefrom and supporting a color selection electrode across the beam path of said tube between said screen and said gun means to determine the particular phosphor material impinged by said beam during the scanning of said screen: an improved electron shield bridging the space between said envelope and said frame to provide substantially complete prevention of electron access to said screen by way of said space notwithstanding the existence of relatively large manufacturing tolerances in said glass envelope section, said shield being impervious to electrons and being composed of a plurality of segments each separately fixed to said frame and each having a curved portion conforming to and separately indexed to a single corner of said rectangular panel section.

19. An electron shield in accordance with claim 18, in which said shield is composed of four segments, and in which each of said curved portions overlaps the end of an adjacent segment.

20. In a color cathode-ray tube of the type having a glass envelope comprising a generally rectangular image screen panel section and a mating funnel section adapted to be sealed thereto, an interlaced pattern of different kinds of phosphor materials disposed on said screen, an electron gun means for developing at least one electron beam to be scanned across said screen, and a generally rectangular structural frame attached to said envelope but spaced therefrom and supporting a color selection electrode across the beam path of said tube between said screen and said gun means to determine the particular phosphor material impinged by said beam during the scanning of said screen: an improved electron shield bridging the space between said envelope and said frame to provide substantially complete prevention of electron access to said screen by way of said space notwithstanding the existence of relatively large manufacturing tolerances in said glass envelope section, said shield being impervious to electrons and being composed of a plurality of segments each separately fixed to said frame and each having a curved portion conforming to and indexed to one corner of said rectangular panel section.

* * * * *